US006614640B2

(12) United States Patent
Richter et al.

(10) Patent No.: US 6,614,640 B2
(45) Date of Patent: Sep. 2, 2003

(54) SURGE ARRESTER

(75) Inventors: Bernhard Richter, Wettingen (CH); Stephan Hoffarth, Baden (CH); Michael Hagemeister, Zürich (CH)

(73) Assignee: ABB Schweiz AG, Baden (CH)

( * ) Notice: Subject to any disclaimer, the term of this patent is extended or adjusted under 35 U.S.C. 154(b) by 277 days.

(21) Appl. No.: 09/756,912

(22) Filed: Jan. 10, 2001

(65) Prior Publication Data

US 2001/0019471 A1 Sep. 6, 2001

(30) Foreign Application Priority Data

Jan. 10, 2000 (DE) ..... 100 00 617

(51) Int. Cl.[7] ..... H01C 7/12
(52) U.S. Cl. ..... 361/117; 361/118; 361/127
(58) Field of Search ..... 361/117, 126, 361/127, 124

(56) References Cited

U.S. PATENT DOCUMENTS

| | | | | |
|---|---|---|---|---|
| 1,071,044 A | | 8/1913 | Gilson | |
| 4,780,598 A | * | 10/1988 | Fahey et al. | 219/511 |
| 4,812,944 A | * | 3/1989 | Eberhard et al. | 361/127 |
| 6,396,676 B1 | * | 5/2002 | Doone et al. | 361/117 |

FOREIGN PATENT DOCUMENTS

| | | | |
|---|---|---|---|
| DE | 1 036 985 | | 2/1958 |
| DE | 195 04 532 | | 8/1996 |
| DE | 194 45 505 | | 5/1997 |
| DE | 93 21 370 | | 9/1997 |
| DE | 197 28 961 | | 2/1999 |
| GB | 2322487 | * | 8/1998 |

* cited by examiner

*Primary Examiner*—Kim Huynh
(74) *Attorney, Agent, or Firm*—Burns, Doane, Swecker & Mathis, L.L.P.

(57) ABSTRACT

The surge arrester has an arrester housing, two electrical power connections (16, 17) which are routed out of the arrester housing, and at least one varistor, which is arranged in the arrester housing (1, 2), is in the form of a disc and has two contact points which are provided on the end faces. The contact points are each electrically conductively connected to one of the two electrical power connections (16, 17).

Figure 1:
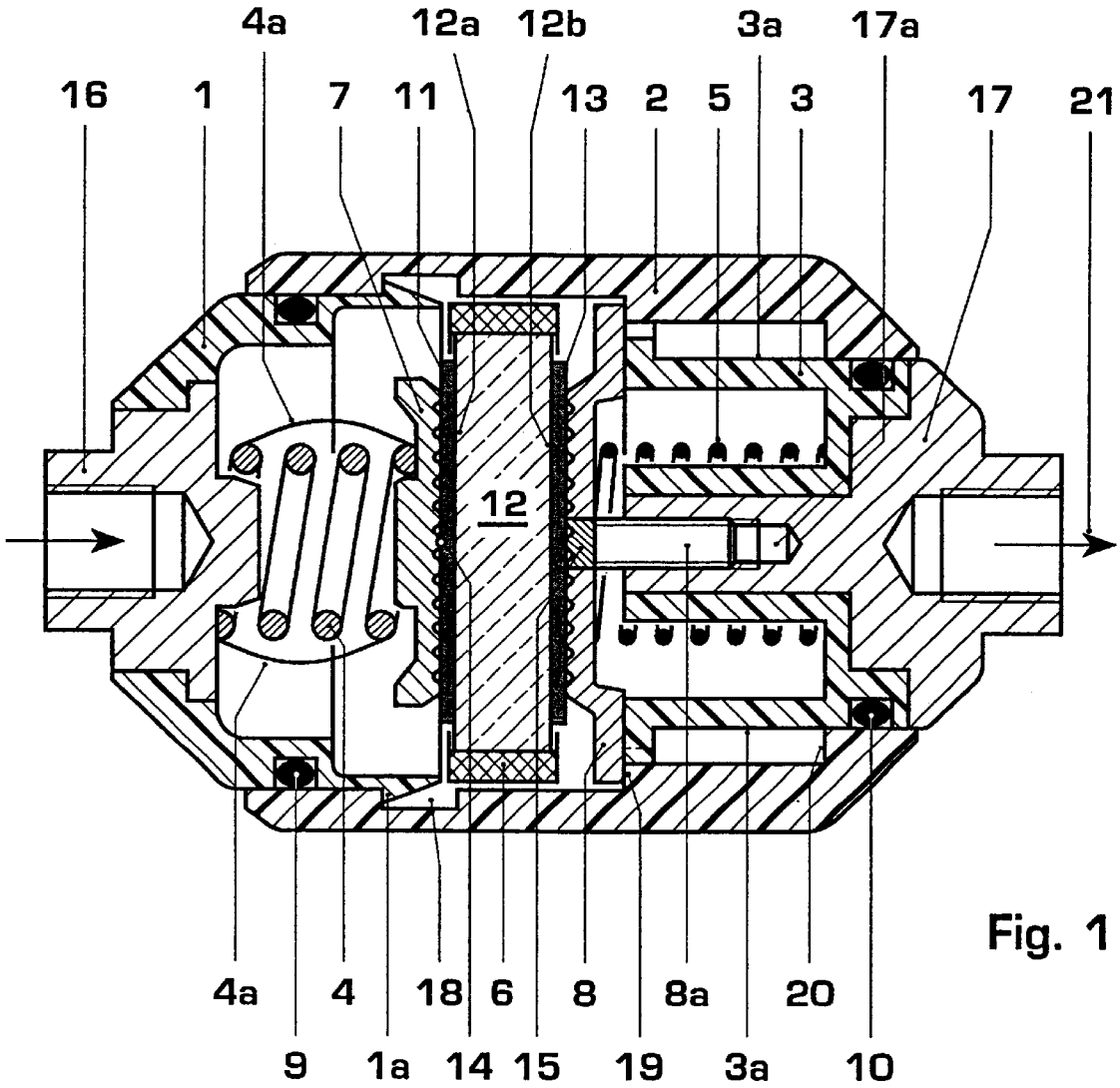

The varistor contains a non-metallized active part (12) and two elastic contact elements (11, 13) which are pressed against the end faces of the active part (12), forming an electrical contact. The end surfaces (12*a*, 12*b*) may be convex or concave instead of being plane-parallel and, if they are in the desired plane-parallel form, form a small angle with respect to one another. The elastic contact elements (11, 13) and the non-metallized end surfaces (12*a*, 12*b*) allow good electrical contact in all cases. Since, during manufacture of the active part, the geometric tolerance limits can be kept relatively wide, the surge arrester can be produced extremely cost-effectively.

17 Claims, 1 Drawing Sheet

SURGE ARRESTER

The invention is based on a surge arrester as claimed in the preamble of patent claim 1.

The preamble of patent claim 1 of the invention refers to a prior art as is known from DE 19545505 C1. In the case of the surge arrester described there, for low-voltage systems, a varistor is thermally conductively connected to a thermal disconnection device comprising a fuse strip and a thermal release with a eutectic fuse alloy, and this results in the thermal release being disconnected, and a damage indicator being initiated by spring force, if the varistor is unacceptably heated. In this case, the fuse strip, which is resistant to surge currents, is arranged with weak points within a fuse housing and melts in the event of a release, overcoming the fastening of the damage indicator within the fuse housing. The thermal release, which is arranged outside the fuse housing, comprises an identifying signaling wire which keeps the damage indicator in the "no indication" position and is broken when the fuse strip melts, or is melted by the short-circuit current. This surge arrester is relatively complex to produce.

The invention, as it is defined in patent claim 1, achieves the object of specifying a surge arrester of the type mentioned initially which can be produced easily and cost-effectively and is nevertheless distinguished by excellent operating characteristics.

In the surge arrester according to the invention, the varistor contains a non-metallized active part and two elastic contact elements, which are pressed against the end faces of the active part, forming an electrical contact and are preferably formed from graphite. These measures result in good electrical power transfer with a largely uniform current density from the active part to the rigid contact elements which produce the contact pressure, and these contact elements are electrically conductively connected to the electrical power connections of the surge arrester. Even if the end surfaces of the active part are not completely planar with respect to one another, but, possibly, are slightly curved in the concave or convex sense or are inclined at a small angle to one another, an excellent operating behavior is thus always achieved.

For certain embodiments of the surge arrester, it is sufficient for the active part not to be passivated at the edge.

A surge arrester having good long-term stability is obtained if the active part of the varistor is passivated at the edge, as can be achieved by the varistor having electrical insulation applied to its edge, said electrical insulation being composed of glass, epoxy varnish or a rubber or silicone ring drawn over the varistor edge. If the passivation has a ring and this ring is higher than the active part and/or the ring has an embossed profile, then it can also be used for positioning of the contact elements, which are designed to be elastic.

If the surge arrester according to the invention contains an electrical power interrupter which is in the form of a melting connection, and a damage indicating apparatus to which prestressing is applied when the electrical power interrupter is closed and which is visible once the electrical power interrupter is open, then it can be recommended that the melting connection be formed into an element of the electrical power interrupter which is in the form of a disc and is pressed against one of the two elastic contact elements of the varistor forming the contact force, since this then ensures good heat transfer from the varistor to the melting connection, and thus also reliable tripping of the electrical power interrupter.

Extremely cost-effective manufacture of a surge arrester according to the invention can be achieved if the arrester housing is predominantly axially symmetrical and has two housing parts which are connected to one another with a force fit forming the contact pressure and the prestress, in which an opening for the first electrical power connection and a part of the damage indicating apparatus which contains a signaling surface to pass through is formed in a first housing part, and an opening for the second electrical power connection to pass through is formed in a second housing part. During the manufacture of this arrester, only prefabricated parts, such as a connecting fitting or a component which contains this connecting fitting, a damage indicating apparatus and a prestressed electrical power interrupter, one of the electrical contact elements, the active part, a further one of the elastic contact elements, an electrical power transmission element which may be connected to this contact element, and a compression spring which produces a contact force are inserted into a predominantly tubular housing part, and the inserted parts are fixed, forming the contact force, by snapping them into a housing part which is in the form of a cap and contains a second connecting fitting.

The surge arrester formed in such a way can thus be manufactured very quickly and using extremely simple means, in particular even locally.

Figure 2:
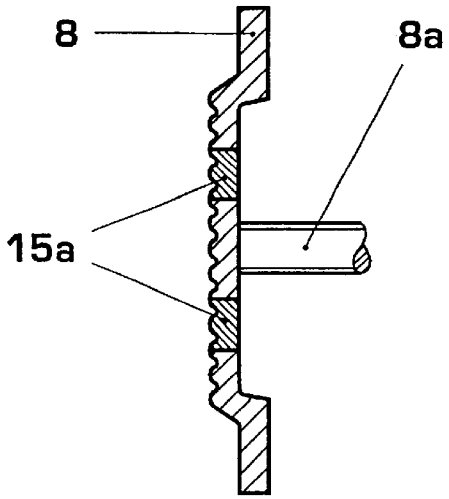

The invention will be explained in the following text with reference to exemplary embodiments. In the figures:

FIG. 1 shows a cross-sectional view of a surge arrester for low voltage with an electrical power interrupter having a thermal release in the form of a point, and FIG. 2 shows an electrical power release with an annular thermal release for the surge arrester shown in FIG. 1.

In the figures, identical parts are identified by having the same reference symbols. FIG. 1 shows a cross section through a surge arrester having a arrester housing which is in two parts, is predominantly axially symmetrical and is composed of plastic, preferably such as a mechanically reinforced polyamide which is stabilized against photo-oxidation. Suitable reinforcement can be achieved by insertion of a filler, preferably in the form of glass spheres. An inner cutout 18 for a snap-action locking apparatus 1*a* of a housing part 1 (which is in the form of an insulating cap) to engage in is formed in a predominantly tubular housing part 2, and the housing part 1 is connected, in a watertight fashion, firstly firmly to a metallic electrical power connection 16 and, secondly, via a sealing ring 9, in the form of an O-ring, to the housing part 2. An electrical power transmission element 7, which is predominantly in the form of a disc, has an electrically conducive pressure connection to the electrical power connecting contact 16 via a metallic, electrically conductive compression spring 4. The compression spring 4 exerts a force, which can be preset and is, for example, 200 N, on the electrical power transmission element 7; in order to short-circuit its induction, it is bridged on the outside by flexible short-circuiting elements 4*a* composed of tinned copper.

An opposing bearing 19 in the housing part 2, which bearing is in the form of an inner annular shoulder, provides a rest, at the edge, for an electrical power transmission element 8, which is predominantly in the form of a disc, of an electrical power interrupter, which is firmly connected to an electrically conductive part of the electrical power interrupter, in the form of a threaded pin 8*a*, via a central point or circular-cylindrical melting connection 15, preferably silver solder, which melts at a temperature which can be preset but is in a typical temperature range of 140° C. to 300° C., preferably 180° C. The pen 8*a* is screwed into a threaded hole 17*a* in an electrical power connection 17, and is thus electrically connected to the latter. A fixed, integral, electrically conductive contact can also be provided (not illustrated) instead of this screw contact. The interior of the housing part 2 contains, between the electrical power interrupter and the electrical power connection 17, an electrically insulating, rotationally symmetrical damage indicating apparatus 3 having an external signaling surface 3*a*, preferably composed of a phosphorescent and/or fluorescent material, so that fault identification is clearly possible even in poor visibility conditions. When the surge arrester is in the operating state, this damage indicating apparatus firstly rests at the edge, by means of a flange, on the electrical power transmission element 8 of the electrical power interrupter; secondly it rests in a watertight manner via a sealing ring 10, which is in the form of an O-ring, on an end part of the housing part 2 and on the electrical power connecting contact 17. A compression spring 5, which produces a smaller stressing force than the compression spring 4, for example 50 N, is arranged in a cutout in the damage indicating apparatus 3. This compression spring is supported at one end on the damage indicating apparatus 3, and at the other end on the part 8 of the electrical power interrupter.

The electrical power transmission element 7 forms an electrically highly conductive pressure connection via a grooved surface and via an elastic contact element 13, which is preferably in the form of a graphite disc, with one end surface 12*a* of an active part 12, which is preferably in the form of a disc, of a varistor. The electrical power transmission element 8 has an electrically highly conductive pressure connection via a grooved surface and via an elastic contact element 13, which is likewise in the form of a graphite disc, with one end surface 12*b* of the active part 12. In this case, the compression spring 4 presses the active part of the varistor via the electrical power transmission element 7 against the opposing bearing 19 of the housing part 2. The grooved contact surfaces of the electrical power transmission elements 7, 8 result in force being transmitted uniformly to the elastic contact elements 11, 13, and in good heat transfer from the active part 12 to the electrical power transmission element 8 of the electrical power interrupter. In the center of its grooved surface, the transmission element 7 is firmly connected to the elastic contact element 11 by means of a droplet 14 of a fast-curing adhesive.

The active part 12, which is preferably composed of a metal oxide, in particular based on zinc oxide, is not metallized on its end surfaces 12*a*, 12*b*. At the edge, it is coated or covered with a dielectric passivation means, such as electrical insulation composed of glass or epoxy varnish or a ring 6, preferably composed of a dielectric elastomer, in particular such as silicone. The ring 6 is somewhat higher than the active part 12 of the varistor so that, at the same time, it forms a centering means for the elastic contact elements 11, 13 and the active part 12.

The surge arrester has a high impedance in the normal operating state. If dangerous overvoltages occur, for example caused by atmospheric discharges or by switching processes, the electrical resistance of the varistor falls as the electrical voltage rises, thus limiting this voltage. If the temperature of the varistor rises owing to overloading and the melting temperature of the melting connection 15 is reached in the process, then the melting connection opens. The compression spring 5 now presses the damage indicating apparatus 3 together with the electrical power connecting contact 17 in the direction of an arrow 21 to the right until the flange at the edge of the damage indicating apparatus 3, which was previously in contact with the part 8 of the electrical power interrupter, makes contact with a contact surface or an opposing bearing 20 on the housing part 2. In consequence, any undesirably high current is interrupted by the varistor, and the signaling surface 3*a* of the apparatus 3 is visible from outside the housing part 2 (not illustrated). This electrical power disconnection leads to a permanent, defined state, in which no free-forming connections and no consequential damage can occur after disconnection. The surge arrester can be installed in any desired orientation in an electrical system which is to be protected, although at least one of the two electrical power connecting contacts 16, 17 must be connected such that it is flexible.

FIG. 2 shows the electrical power transmission element 8 of the electrical power interrupter with a melting connection 15*a* arranged in a ring around its center rather than a point melting connection 15 as shown in FIG. 1. The electrical power interrupter equipped with this melting connection has the advantage that the electrical power disconnection can be adjusted more precisely, since the melting region 15*a* is not directly linked to the threaded pin 8*a*, which acts as a heat dissipator.

It is self-evident that the surge arrester may also be equipped with a number of varistors 12 (not illustrated). Instead of being plane-parallel, their end surfaces 12*a*, 12*b* may, for example, also be convex or concave (not illustrated). The elastic contact elements 11, 13 and the non-metallized end surfaces 12*a*, 12*b* each allow good electrical contact.

LIST OF REFERENCE SYMBOLS

| | |
|---|---|
| 1,2 | Housing parts |
| 1a | Snap-action locking apparatus |
| 3 | Damage indicating apparatus |
| 3a | Signaling surface |
| 4,5 | Compression springs |
| 4a | Short-circuiting elements |
| 6 | Ring |
| 7,8 | Electrical power transmission elements |
| 8a | Threaded pin |
| 9,10 | Sealing rings |
| 11,13 | Elastic contact elements |
| 12 | Active part |
| 12a,12b | End surfaces |
| 14 | Droplet |
| 15,15a | Melting connections |
| 16,17 | Electrical power connections |
| 17a | Threaded hole |
| 18 | Cutout |
| 19,20 | Opposing bearing |
| 21 | Arrow |

What is claimed is:

1. A surge arrester comprising:

an arrester housing, two current terminals passing through the arrester housing, and at least one disk-like varistor arranged in the arrester housing and having two end surfaces, a non-metallized active part and two elastic contact elements, two current transmission elements, wherein each of the two current transmission elements is in electrical contact with only one of the two end surfaces of the at least one disk-like varistor and wherein each of the two current transmission elements is electrically conductively connected to only one of the two current terminals, wherein each of the two elastic contact elements of the varistor is pressed against the non-metallized active part of the varistor in an electrically conducting manner via only one of the two current transmission elements.

2. The surge arrester as claimed in claim 1, characterized in that at least one of the two contact elements is a graphite disc.

3. The surge arrester as claimed in claim 1, characterized in that the active part is not passivated.

4. The surge arrester as claimed in claim 1, characterized in that the active part is passivated at the edge.

5. The surge arrester as claimed in claim 4, characterized in that the active part has a ring at the edge.

6. The surge arrester as claimed in claim 5, characterized in that the ring is higher than the active part in such a manner that it forms a boundary at the edge for positioning of the contact elements.

7. The surge arrester as claimed in claim 5, characterized in that the ring is formed by a dielectric elastomer, in particular a silicone.

8. The surge arrester as claimed in claim 1, having an electrical power interrupter, which is arranged in the electrical connection between a first of the two contact elements and a first of the two electrical power connections and is in the form of a melting connection, and having a damage indicating apparatus to which prestressing is applied when the electrical power interrupter is closed and which is visible when the electrical power interrupter is open, characterized in that the melting connection is formed into an element of the electrical power interrupter which is in the form of a disc and is pressed against the first contact element forming a contact force.

9. The surge arrester as claimed in claim 8, characterized in that the element which is in the form of a disc has a grooved surface which is pressed against the contact surface.

10. The surge arrester as claimed in claim 8, characterized in that the melting connection is in the form of a point or ring.

11. The surge arrester as claimed in claim 8, characterized in that the arrester housing is predominantly axially symmetrical and has two housing parts which are connected to one another with a force fit forming the contact pressure and the prestress, and in which an opening for the first electrical power connection and a part of the damage indicating apparatus which contains a signaling surface to pass through is formed in a first housing part, and an opening for the second electrical power connection to pass through is formed in a second housing part.

12. The surge arrester as claimed in claim 11, characterized in that the two housing parts are snapped together.

13. The surge arrester as claimed in claim 12, characterized in that the prestressing is produced by a first compression spring which is supported between the element which is in the form of a disc, and the damage indicating apparatus, and the contact force is produced by means of a second compression spring which acts on the second contact element.

14. The surge arrester as claimed in claim 13, characterized in that the second compression spring is bridged by flexible short-circuiting elements.

15. The surge arrester as claimed in claim 10, characterized in that the arrester housing is composed of a mechanically reinforced polyamide which is stabilized against photo-oxidation.

16. A surge arrester comprising:

an arrester housing, two electrical power connections which are routed out of the arrester housing, and at least one varistor which is arranged in the arrester housing, is in the form of a disc and has two contact points which are provided on the end faces and are each electrically conductively connected to one of the two electrical power connections, wherein the varistor includes a non-metallized active part and two elastic contact elements which are pressed against the end faces of the active part, forming an electrical contact, wherein the active part is passivated at the edge, and wherein the varistor includes a ring at the edge of the active part, the ring being higher than the active part in such a manner that it forms a boundary at the edge for positioning the contact elements.

17. A surge arrester comprising:

an arrester housing, two electrical power connections which are routed out of the arrester housing, at least one varistor which is arranged in the arrester housing, is in the form of a disc and has two contact points which are provided on the end faces and are each electrically conductively connected to one of the two electrical power connections, wherein the varistor includes a non-metallized active part and two elastic contact elements which are pressed against the end faces of the active part, forming an electrical contact, and an electrical power interrupter, which is arranged in the electrical connection between a first of the two contact elements and a first of the two electrical power connections and is in the form of a melting connection, and which includes a damage indicating apparatus to which prestressing is applied when the electrical power interrupter is closed and which is visible when the electrical power interrupter is open, wherein the melting connection is formed into an element of the electrical power interrupter which is in the form of a disc and is pressed against the first contact element forming a contact force.

* * * * *